US011437747B2

(12) United States Patent
Tziviskos

(10) Patent No.: US 11,437,747 B2
(45) Date of Patent: Sep. 6, 2022

(54) SPRING-LOADED CONTACTS HAVING CAPSULE INTERMEDIATE OBJECT

(71) Applicant: Apple Inc., Cupertino, CA (US)

(72) Inventor: George Tziviskos, San Jose, CA (US)

(73) Assignee: Apple Inc., Cupertino, CA (US)

( * ) Notice: Subject to any disclaimer, the term of this patent is extended or adjusted under 35 U.S.C. 154(b) by 25 days.

(21) Appl. No.: 17/033,514

(22) Filed: Sep. 25, 2020

(65) Prior Publication Data

US 2022/0102893 A1 Mar. 31, 2022

(51) Int. Cl.
*H01R 13/17* (2006.01)
*H01R 13/62* (2006.01)

(52) U.S. Cl.
CPC ..... *H01R 13/17* (2013.01); *H01R 13/6205* (2013.01); *H01R 2201/06* (2013.01)

(58) Field of Classification Search
CPC ..... H01R 13/17
USPC ..... 439/700
See application file for complete search history.

(56) References Cited

U.S. PATENT DOCUMENTS 2,644,145 A * 6/1953 Adams ..... H01R 13/2421 439/824
3,378,810 A * 4/1968 Dorrell ..... H01R 13/2471 439/700
3,435,168 A * 3/1969 Cooney ..... G06K 7/042 324/755.05
3,753,103 A * 8/1973 Tetreault ..... G01R 1/06722 324/72.5
4,050,762 A * 9/1977 Hines ..... G01R 1/06722 439/824
4,397,519 A * 8/1983 Cooney ..... H01R 13/2421 324/755.05
4,597,622 A 7/1986 Coe
4,612,703 A 9/1986 Cooney
4,686,465 A 8/1987 Kruger
4,874,316 A 10/1989 Kamon et al.
4,983,909 A 1/1991 Swart et al.
5,417,595 A 5/1995 Cullen et al.
5,801,544 A 9/1998 Swart et al.
5,993,269 A 11/1999 Ito
6,053,777 A 4/2000 Boyle
6,159,056 A 12/2000 Boyle
6,377,059 B2 4/2002 Vinther et al.
6,447,328 B1 9/2002 Feldman
6,506,082 B1 1/2003 Meek et al.
6,604,864 B2 8/2003 Nguyen
(Continued)

FOREIGN PATENT DOCUMENTS

JP 508785 3/1975
JP 6276668 5/1987
(Continued)

*Primary Examiner* — Neil Abrams
(74) *Attorney, Agent, or Firm* — Kilpatrick Townsend & Stockton, LLP

(57) ABSTRACT

Reliable contacts for connectors, connector receptacles that can be easily aligned to an opening in an electronic device, and connector inserts and connector receptacles that are readily manufactured. One example can provide a spring-biased contact having plunger extending through an opening in a barrel and biased by a spring. An intermediate object can be positioned between the plunger and the spring. The intermediate object can contact a barrel in at least two locations on the barrel.

20 Claims, 16 Drawing Sheets

(56) References Cited

U.S. PATENT DOCUMENTS

| | | | | |
|---|---|---|---|---|
| 6,696,850 | B1 | 2/2004 | Sanders | |
| 6,758,682 | B1 * | 7/2004 | Kosmala | H01R 13/2421 439/66 |
| 6,861,862 | B1 | 3/2005 | Tate | |
| 6,957,986 | B2 | 10/2005 | Jing | |
| 7,315,176 | B2 | 1/2008 | Nelson et al. | |
| 7,611,389 | B2 * | 11/2009 | Toivanen | H01R 13/2471 439/700 |
| 7,682,206 | B2 | 3/2010 | Kainz | |
| 7,749,032 | B1 * | 7/2010 | Yin | H01R 13/2421 439/482 |
| 7,798,867 | B2 | 9/2010 | Sanders | |
| 8,043,103 | B2 | 10/2011 | Yamada et al. | |
| 8,337,256 | B1 | 12/2012 | Lin | |
| 8,734,189 | B2 | 5/2014 | Kim | |
| 8,905,795 | B2 * | 12/2014 | Kim | H01R 13/17 439/700 |
| 8,926,376 | B2 | 1/2015 | Mori | |
| 9,130,317 | B2 | 9/2015 | Wang et al. | |
| 9,431,742 | B2 * | 8/2016 | DiFonzo | H01R 13/17 |
| 9,748,680 | B1 | 8/2017 | Huang et al. | |
| 9,780,475 | B2 * | 10/2017 | Kim | H01R 13/2471 |
| 10,114,038 | B2 * | 10/2018 | Tong | G01R 1/06722 |
| 10,367,279 | B2 * | 7/2019 | Mardi | H01R 12/7076 |
| 2003/0124895 | A1 * | 7/2003 | Winter | H01R 13/2421 439/219 |
| 2003/0176113 | A1 | 9/2003 | Sasaki | |
| 2004/0137800 | A1 | 7/2004 | Jing | |
| 2010/0089187 | A1 * | 4/2010 | Yin | G01R 1/06722 73/866.5 |
| 2011/0018567 | A1 | 1/2011 | Shiga | |
| 2013/0095690 | A1 | 4/2013 | Kim et al. | |
| 2013/0330983 | A1 | 12/2013 | DiFonzo et al. | |
| 2016/0020542 | A1 | 1/2016 | DiFonzo et al. | |
| 2022/0102893 | A1 * | 3/2022 | Tziviskos | H01R 13/17 |

FOREIGN PATENT DOCUMENTS

| | | |
|---|---|---|
| JP | 6323655 | 2/1988 |
| JP | 63274070 | 11/1988 |
| JP | 972932 | 3/1997 |
| JP | 1040990 | 2/1998 |
| JP | 10282142 | 10/1998 |
| JP | 10332767 | 12/1998 |
| JP | 2001021583 | 1/2001 |
| JP | 2002174642 | 6/2002 |
| JP | 2003281984 | 10/2003 |
| JP | 2004179066 | 6/2004 |
| JP | 2005005146 | 1/2005 |
| JP | 2006501475 | 1/2006 |
| JP | 2007316023 | 12/2007 |
| JP | 2011027549 | 2/2011 |
| JP | 2011192407 | 9/2011 |
| JP | 2013068593 | 4/2013 |
| KR | 200255378 | 11/2001 |
| TW | 200301592 | 7/2003 |
| TW | 563929 | 11/2003 |
| TW | M312806 | 5/2007 |
| TW | I286409 | 9/2007 |
| TW | I289376 | 11/2007 |
| TW | 200803072 | 1/2008 |
| TW | M406183 | 6/2011 |
| WO | 9804018 | 1/1998 |
| WO | 2005053106 | 6/2005 |
| WO | 2013035399 | 3/2013 |

* cited by examiner

SPRING-LOADED CONTACTS HAVING CAPSULE INTERMEDIATE OBJECT

BACKGROUND

The number of types of electronic devices that are commercially available has increased tremendously the past few years and the rate of introduction of new devices shows no signs of abating. Devices such as tablet computers, laptop computers, desktop computers, all-in-one computers, cell phones, storage devices, wearable-computing devices, portable media players, navigation systems, monitors, adapters, and others, have become ubiquitous.

Electronic devices can share power and data over cables that can include one or more wires, fiber optic cables, or other conductors. Connector inserts can be located at each end of these cables and can be inserted into connector receptacles in the communicating electronic devices to form pathways for power and data.

A connector insert can have contacts that mate with corresponding contacts in a connector receptacle. These contacts can form portions of electrical paths for data, power, or other types of signals. One type of contact, a spring-loaded contact, can be used in either a connector insert or a connector receptacle. But a spring-loaded contact can have a reduced reliability, particularly if currents for a power supply flow through the spring.

A connector receptacle can be positioned in an opening in an electronic device. Specifically, the connector receptacle can be mounted on a surface of an enclosure or other substrate in the electronic device and then aligned to the opening. But there can be manufacturing tolerances in the positioning of connector receptacle in the electronic device. Accordingly, it can be desirable to provide connector receptacles that can easily be aligned to an opening in an electronic device.

Also, some of these electronic devices become tremendously popular. As a result, connector receptacles on the electronic devices and connector inserts on cables can be sold in very large quantities. Therefore, it can be desirable that these connectors be readily manufactured such that customer demand for them can be met.

Thus, what is needed are reliable contacts for connectors, connector receptacles that can be easily aligned to an opening in an electronic device, and connector inserts and connector receptacles that are readily manufactured.

SUMMARY

Accordingly, embodiments of the present invention can provide reliable contacts for connectors, connector receptacles that can be easily aligned to an opening in an electronic device, and connector inserts and connector receptacles that are readily manufactured.

An illustrative embodiment of the present invention can provide contacts for connector inserts and connector receptacles that are highly reliable. These contacts can be spring-loaded contacts having a contacting portion or plunger biased by a spring or other biasing structure. As contact is made between a spring-loaded contact and a corresponding contact, the biased plunger can be depressed. The spring can thereby apply a force between the plunger and the corresponding contact to form an electrical connection. Typically, current in the electrical connection can flow through the plunger and a barrel or other housing for the plunger that is in contact with the plunger. But in some configurations, as the plunger is depressed, contact between the plunger and the barrel can be broken. In this circumstance, current can flow through the spring. If the contact is a power supply contact, such as a contact providing a power supply voltage or ground, the current can damage or destroy the spring thereby rendering the contact inoperable.

Accordingly, an illustrative embodiment of the present invention can provide spring-biased contacts that include an intermediate object between a plunger and a spring or other biasing structure. The intermediate object can have a first length that is greater than a diameter of a barrel that houses the plunger, spring and intermediate object. The intermediate object can be between a backside of the plunger and the spring, where the intermediate object simultaneously contacts an inside surface of barrel at a first location and a second location. The first location and the second location can be on opposite sides of the intermediate object. The first location can be a first distance from a front opening of the barrel and the second location can be a second distance from the front opening, where the first distance is different than the second distance.

In these and other embodiments of the present invention, an inside surface of the barrel can provide a first force along a first vector against the intermediate object at the first location and the inside surface of the barrel can provide a second force along a second vector against the intermediate object at the second location. The first force vector and the second force vector can be parallel and non-overlapping.

The intermediate object can have various shapes. For example, the intermediate object can have a capsule shape. The intermediate object can have a stadium-of-rotation shape. The intermediate object can have a spherocylinder shape. The intermediate object can have a shape defined by two hemispheres separated by a cylinder.

In these and other embodiments of the present invention, an interface between the plunger and the spring can be arranged to provide a force between the intermediate object and the barrel. For example, a backside of the plunger can have a sloped surface. The backside of the plunger can have a conical surface. The backside of the plunger can have an off-center conical surface. The backside of the plunger can have a sloped off-center conical surface. The contact can be one of several contacts in a connector receptacle or connector insert.

An illustrative embodiment of the present invention can provide a connector receptacle that can be easily aligned with an opening in a device enclosure for an electronic device. The electronic device can include a printed circuit board or other substrate, and can be at least partially housed in a device enclosure. The device enclosure can have an opening. A connector receptacle can be mounted on a portion of the device enclosure, the board, or other substrate. The connector receptacle can be attached to the enclosure or board using brackets. The brackets can be positionable within a housing of the connector receptacle such that the connector receptacle can be positionable within the electronic device in at least one dimension. This can allow the connector receptacle to be aligned with the opening in the device enclosure of the electronic device.

While embodiments of the present invention can provide connector inserts and connector receptacles for delivering power, these and other embodiments of the present invention can be used as connector receptacles in other types of connector systems, such as connector systems that can be used to convey power, data, or both.

In various embodiments of the present invention, contacts, shields, plungers, springs, isolation objects, pistons, barrels, and other conductive portions of a connector receptacle or connector insert can be formed by stamping, metal-injection molding, machining, CNC machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as housings, locks, pistons, and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The printed circuit boards or other boards used can be formed of FR-4 or other material.

Embodiments of the present invention can provide connector receptacles and connector inserts that can be located in, and can connect to, various types of devices such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. These connector receptacles and connector inserts can provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
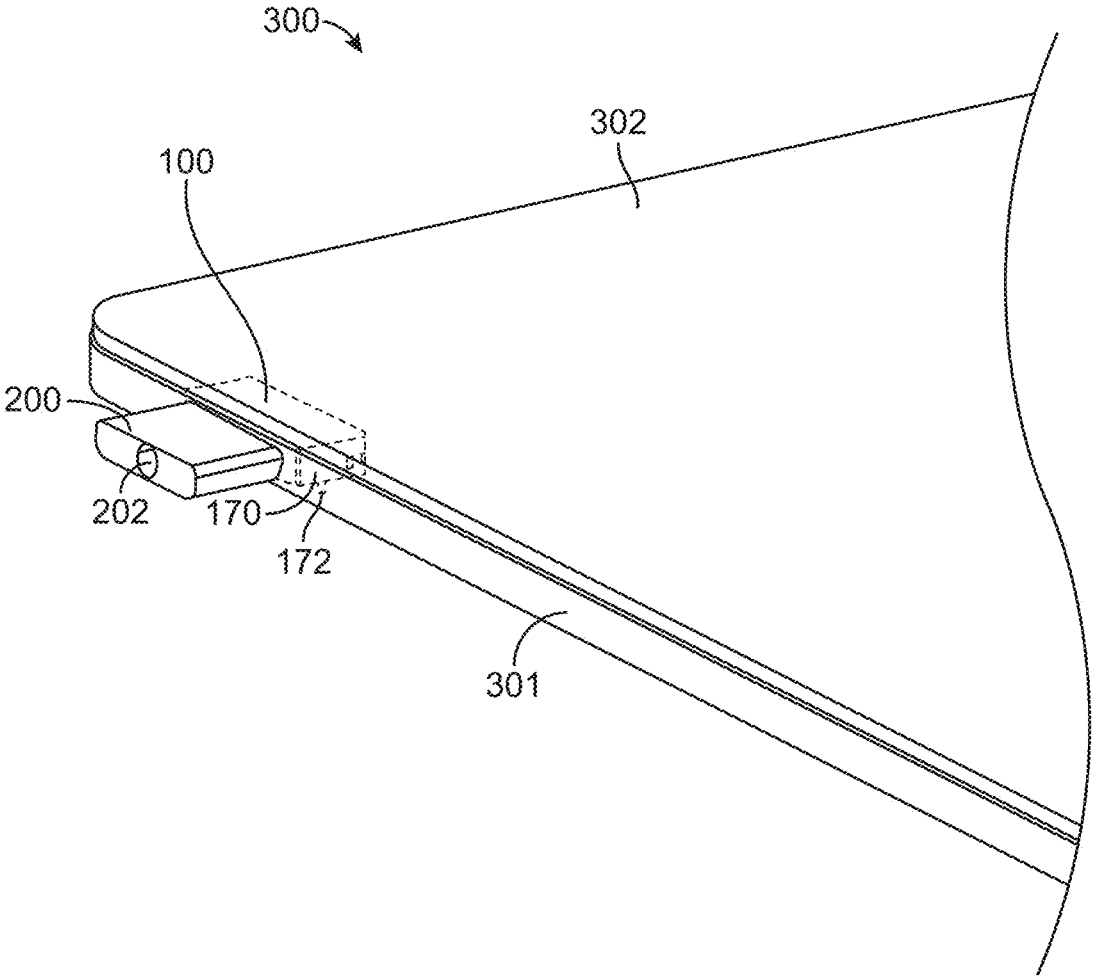
FIG. 1 illustrates an electronic system that can be improved by the incorporation of embodiments of the present invention.

FIG. 1 illustrates an electronic system that can be improved by the incorporation of an embodiment of the present invention. This figure, as with the other included figures, is shown for illustrative purposes and does not limit either the possible embodiments of the present invention or the claims.

This figure illustrates an electronic device 300 including connector receptacle 100. Electronic device 300 can include bottom enclosure 301 encasing connector receptacle 100. Electronic device 300 can further include top enclosure 302 over bottom enclosure 301. Top enclosure 302 can house a screen or monitor, or other electronic components (not shown.) Bottom enclosure 301 can house a keyboard, processor, battery, or other electronic components (not shown.) The electronic components in top enclosure 302 and bottom enclosure 301 can receive and provide power and data using connector receptacle 100. In one example, the electronic components in top enclosure 302 and bottom enclosure 301 can receive power via connector receptacle 100 and can provide data regarding a charging status of a battery of electronic device 300 via connector receptacle 100.

Connector receptacle 100 can include shield 170 having tabs 172. Tabs 172 can be inserted into and soldered to openings (not shown) in a printed circuit board (not shown) in bottom enclosure 301 of electronic device 300. Connector insert 200 can be plugged into or mated with connector receptacle 100. Connector insert 200 can include passage 202 for a cable (not shown.)

In this example, electronic device 300 can be a laptop or portable computer. In these and other embodiments of the present invention, electronic device 300 can instead be another portable computing device, tablet computer, desktop computer, all-in-one computer, wearable-computing device, smart phone, storage device, portable media player, navigation system, monitor, power supply, video delivery system, adapter, remote control device, charger, or other device.

Power supplies, ground, and data signals can be conveyed by connector insert 200 and connector receptacle 100. These power supplies, ground, and signals can be compliant with and form pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

Examples of connector receptacles 100 and connector inserts 200 are shown in the following figures.

Figure 2:
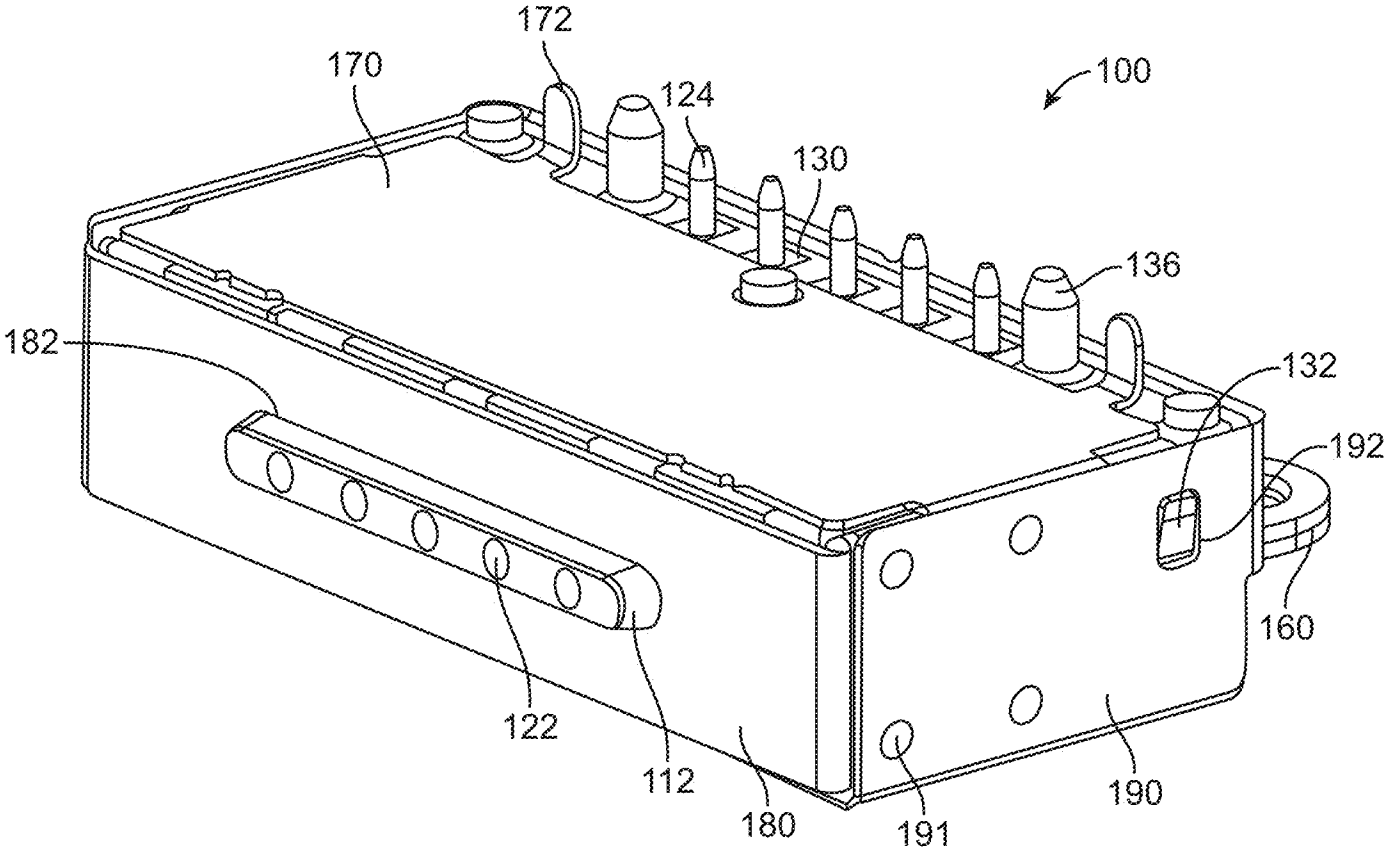
FIG. 2 illustrates a connector receptacle according to an embodiment of the present invention.

FIG. 2 illustrates a connector receptacle according to an embodiment of the present invention. Connector receptacle 100 can include mesa 112 supporting contacting surfaces 122 of contacts 120 (shown in FIG. 4.) Mesa 112 can emerge through opening 182 in face plate 180. Contacts 120 can terminate in through-hole contacting portions 124. In these and other embodiments of the present invention, contacts 120 can terminate in surface-mount contacting portions (not shown.) Housing 130 can include posts 136. Shield 170 can include tabs 172. Through-hole contacting portions 124, posts 136, and tabs 172 can be inserted into corresponding openings in a printed circuit board, flexible circuit board, or other appropriate substrate. Housing 130 can further include tab 132 that can fit an opening 192 of shield 190. Shield 170 can be attached to shield 190 at points 191 by spot or laser-welding or other technique. Bracket 160 can be used to secure connector receptacle 100 in place in electronic device 300 (shown in FIG. 1) as shown further below.

Figure 3:
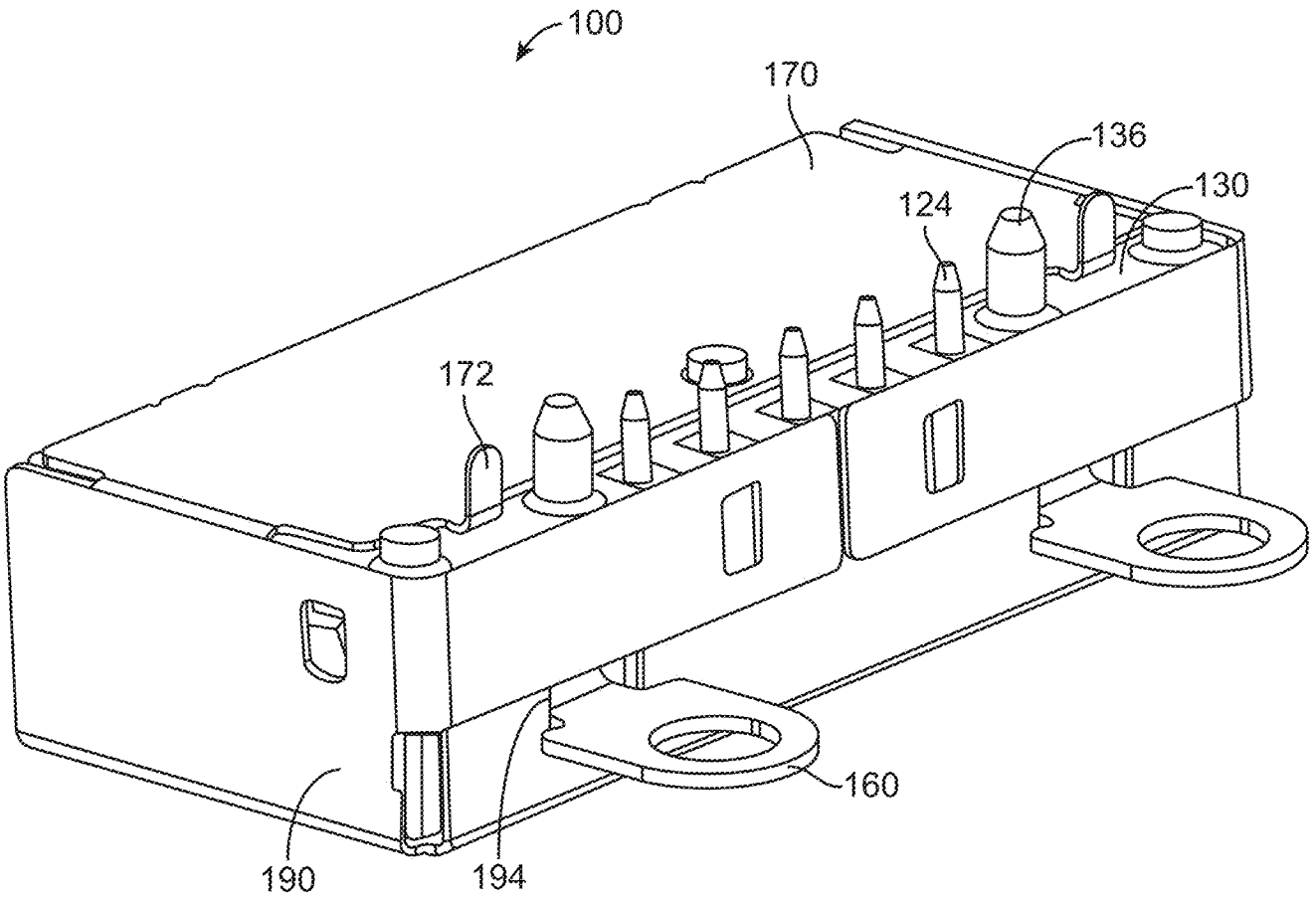
FIG. 3 illustrates the connector receptacle of FIG. 2.

FIG. 3 illustrates the connector receptacle of FIG. 2. Brackets 160 can emerge through the openings 194 in shield 190. Shield 170 can include tabs 172. Contacts 120 (shown in FIG. 4) can terminate in through-hole contacting portions 124. Housing 130 can include posts 136. Through-hole contacting portions 124, posts 136, and tabs 172 can be fit in corresponding openings in a printed circuit board, flexible circuit board, or other appropriate substrate. Brackets 160 can be used secure connector receptacle 100 in place in electronic device 300, as shown in FIG. 1.

Figure 4:
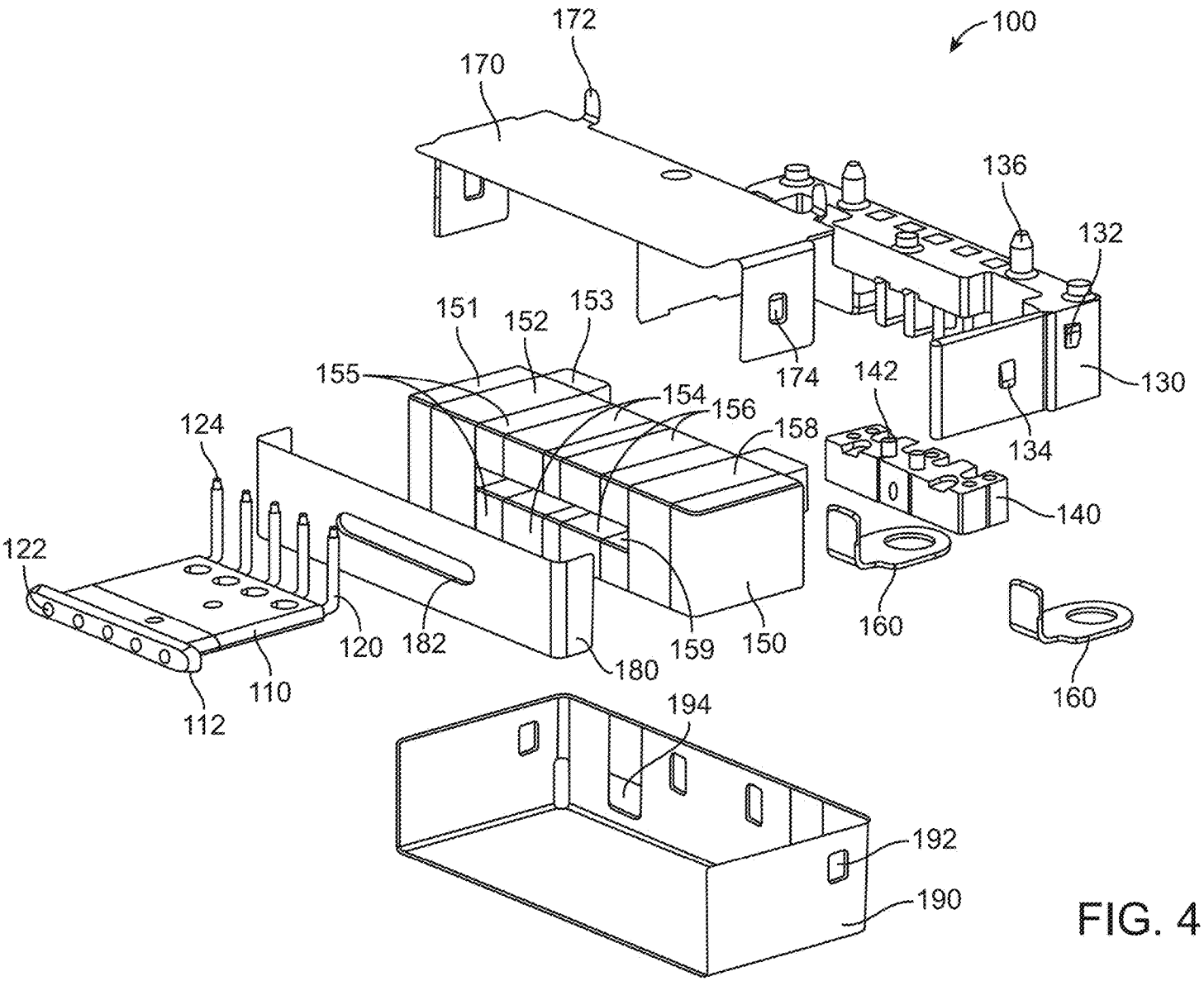
FIG. 4 is an exploded view of the connector receptacle of FIG. 2.

FIG. 4 is an exploded view of the connector receptacle of FIG. 2. Contacts 120 can be supported by contact housing 110. Contact housing 110 can terminate in mesa 112. Contacts 120 can include contacting surfaces 122 on mesa 112 and through-hole contacting portions 124. Mesa 112 can emerge from opening 182 in face plate 180.

Magnet array 150 can be positioned around contact housing 110. Contact housing 110 can pass through an opening 159 in magnet array 150. Magnet array 150 can include pole piece 152, pole pieces 154, pole pieces 156, and pole piece 158. Each of these pole pieces can be formed of a ferromagnetic, ferri-magnetic, or other type of material. Each of these pole pieces can be abutted by two or more magnets. For example, pole piece 152 can be abutted by magnet 151, magnet 153, and magnets 155. Pole piece 152 can guide a magnet polarity, such as a north magnetic polarity. Accordingly, magnet 151, magnet 153, and magnets 155 can have their north pole adjacent to pole piece 152 and their south pole away from pole piece 152. Pole piece 152, pole pieces 154, pole pieces 156, and pole piece 158 be formed of magnetically conductive material, such as stainless steel, or other ferro or ferri-magnetic material, and can have alternating polarities. For example, pole piece 152 and pole pieces 156 can pass field lines of a first polarity and pole pieces 154 and pole piece 158 can pass field lines of a second polarity. For example, pole piece 152 and pole pieces 156 can have a north polarity and pole pieces 154 and pole piece 158 can have a south polarity. Alternatively, pole piece 152 and pole pieces 156 can have a south polarity and pole pieces 154 and pole piece 158 can have a north polarity.

Contact housing 110 can further be supported by housing 130 and lock 140. Contact housing 110 can be positioned between housing 130 and lock 140. Housing 130 can include post 136, tabs 132, and tabs 134. Tab 132 can fit in opening 192 of shield 190. Tab 134 can fit in opening 174 of shield 170. Shield 170 can further include tabs 172. Brackets 160 can fit in openings 194 of shield 190.

It can be desirable to accurately align mesa 112 and contacting surfaces 122 to an opening in device enclosure 301 of electronic device 300 (shown in FIG. 1.) Connector receptacle 100 can be positioned on a surface of or associated with device enclosure 301. This can help to provide an accurate alignment. However, various manufacturing tolerances can remain. Accordingly, it can be desirable to be able to adjust a connection between connector receptacle 100 and device enclosure 301 in at least one direction. An example is shown in the following figure.

Figure 5:
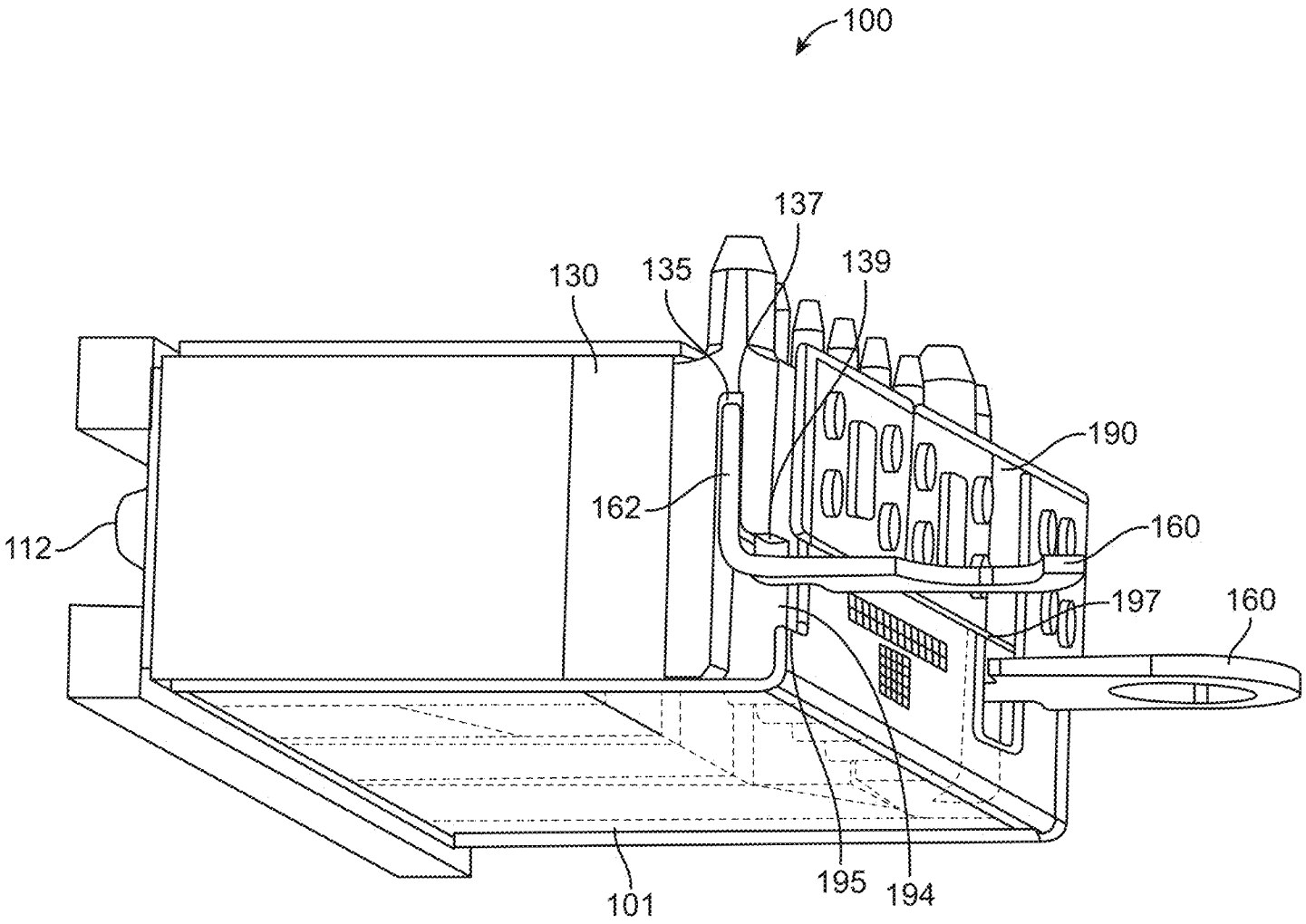
FIG. 5 illustrates a cutaway side view of the connector receptacle of FIG. 2.

FIG. 5 illustrates a cutaway side view of the connector receptacle of FIG. 2. A bottom surface 101 of connector receptacle 100 can be placed on a printed circuit board, enclosure surface, or other appropriate substrate 620 (shown in FIG. 6.) Brackets 160 can be used to secure connector receptacle 100 to substrate 620. To improve alignment of connector receptacle 100 to an opening in enclosure 301 (shown in FIG. 1), it can be desirable that bracket 160 be able to move in at least one direction relative to the other portions of connector receptacle 100. Accordingly, bracket 160 can be positioned in slot 135 in housing 130. In this way, tab 162 of bracket 160 can slide vertically in slot 135. This can allow bracket 160 to move relative to the remainder of connector receptacle 100 and can allow connector receptacle 100 to be accurately positioned in device enclosure 301.

In this example bracket 160 can be capable of moving up board until tab 162 hits a top 137 of slot 135. Also or instead, the upward travel can be limited by an edge 197 at a top of opening 194 in shield 190. Also or instead, the upward travel can be limited by edge 139 of housing 130 engaging bracket 160. Bracket 160 can be capable of moving downward until bracket 160 hits bottom edge 195 of opening 194. This arrangement can allow bracket 160 to move vertically relative to a remaining portion of connector receptacle 100.

Figure 6:
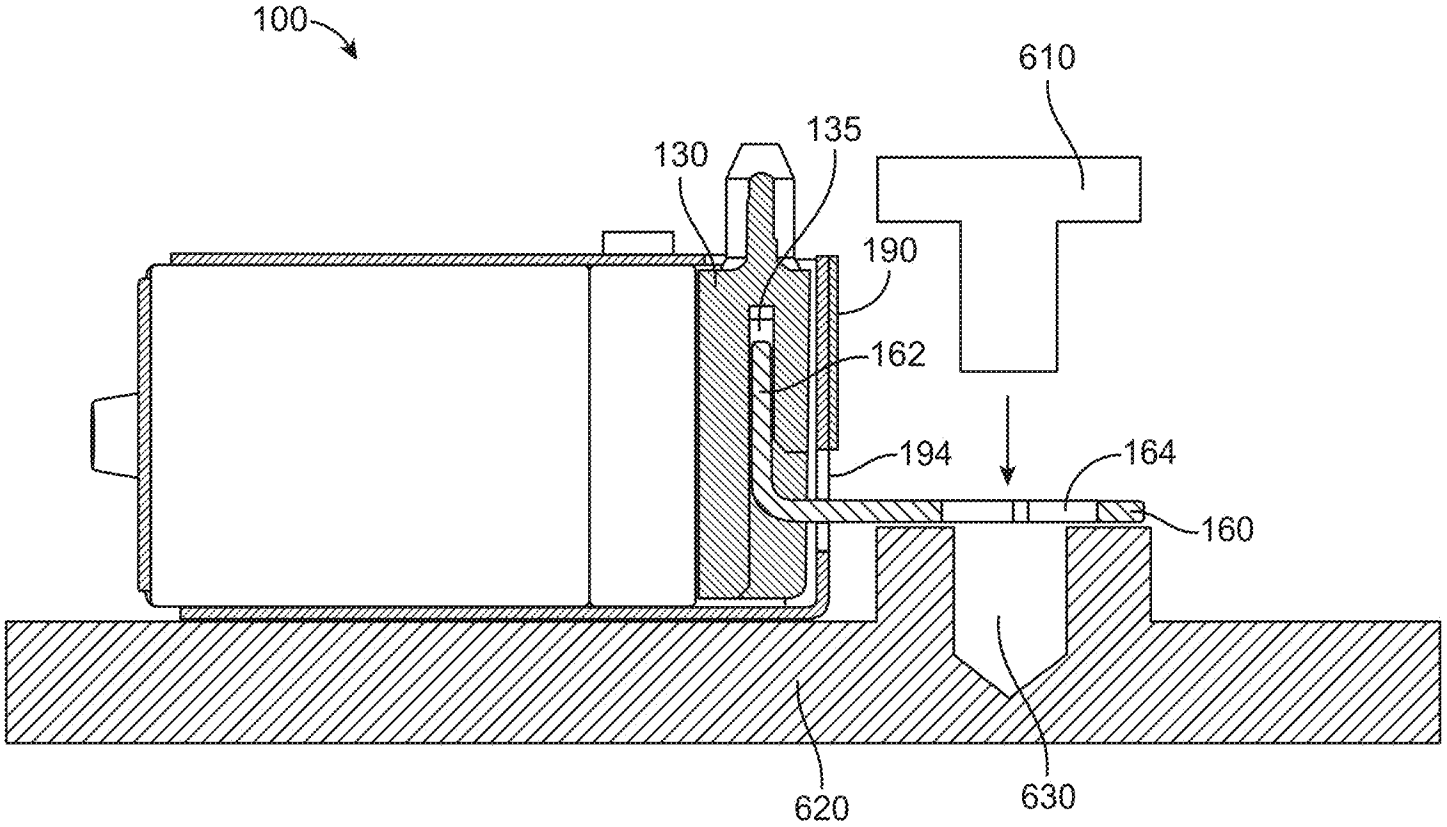
FIG. 6 illustrates a side view of the connector receptacle of FIG. 2 in a device enclosure according to an embodiment of the present invention.

FIG. 6 illustrates a side view of the connector receptacle of FIG. 2 in a device enclosure according to an embodiment of the present invention. In this example, connector receptacle 100 can be mounted on substrate 620. Substrate 620 can be a printed circuit board, portion of device enclosure 301 (shown in FIG. 1), or other appropriate substrate. Substrate 620 can include fastener opening 630 to accept fastener 610. Fastener 610 can pass through opening 164 in bracket 160 to secure bracket 160 and connector receptacle 100 to substrate 620. Again, tab 162 of bracket 160 can move vertically in slot 135 of housing 130. Bracket 160 can pass through opening 194 in shield 190.

Figure 7B:
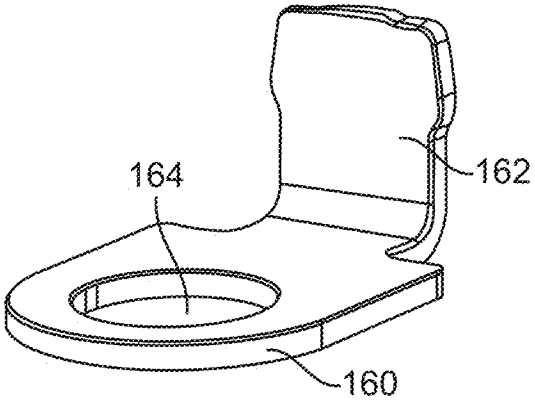
FIG. 7A and FIG. 7B illustrate portions of the connector receptacle of FIG. 2.
Figure 7A:
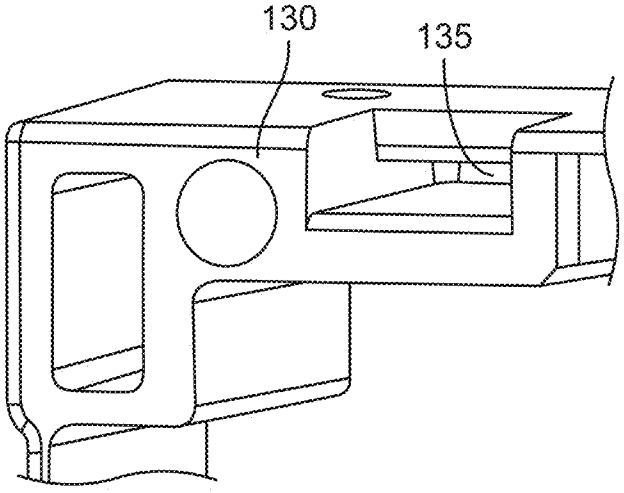

FIG. 7A and FIG. 7B illustrate portions of the connector receptacle of FIG. 2. Housing 130 can include slot 135 for accepting bracket 160. Bracket 160 can include tab 162 and opening 164.

Figure 8:
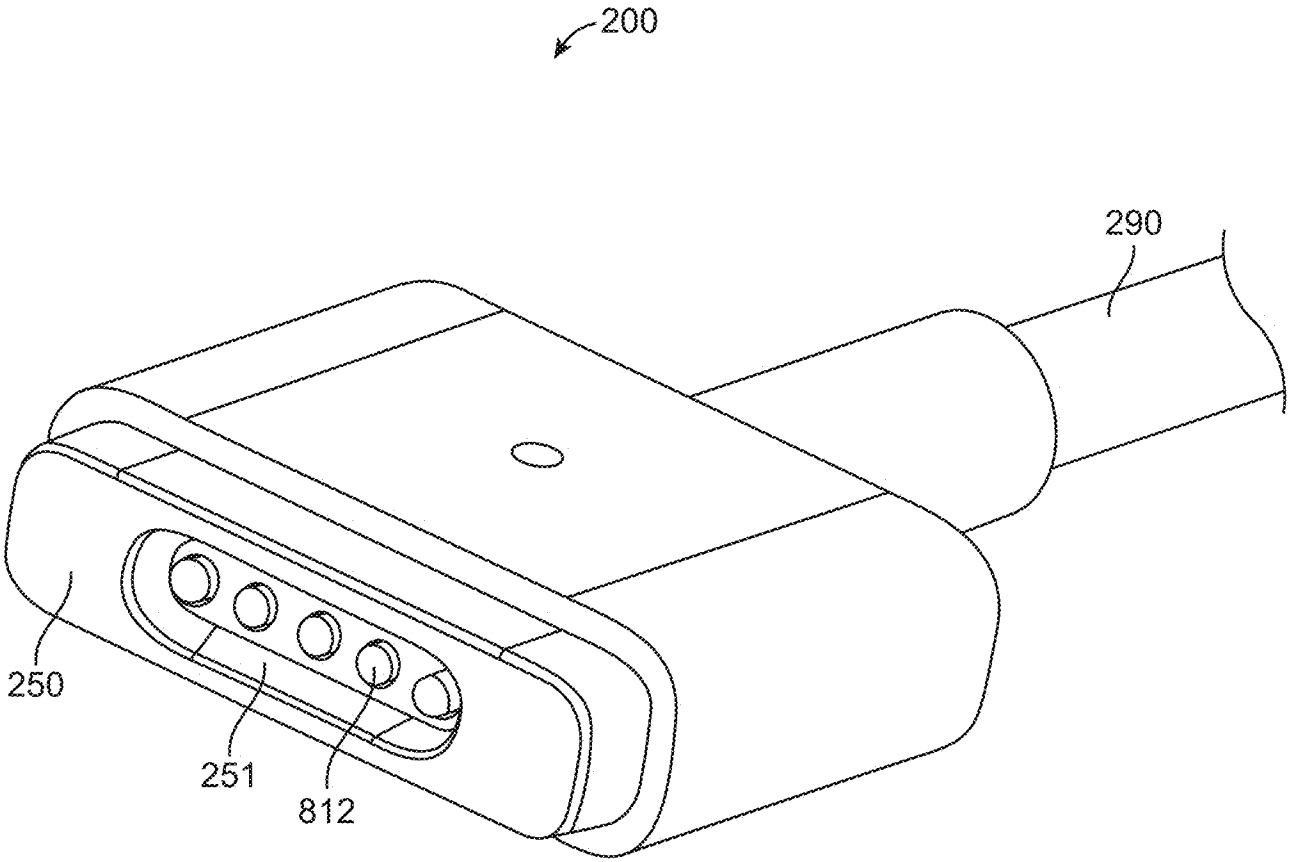
FIG. 8 illustrates a connector insert according to an embodiment of the present invention.

FIG. 8 illustrates a connector insert according to an embodiment of the present invention. Connector insert 200 can be arranged to mate with connector receptacle 100, as shown in FIG. 1. Connector insert 200 can be at a first end of cable 290. Connector insert 200 can include an attraction plate 250 that can be magnetically attracted to magnet array 150 (shown in FIG. 4.) Attraction plate 250 can include opening 251 for accepting mesa 112 (shown in FIG. 2) of connector receptacle 100. Contacting surfaces 122 of contacts 120 (shown in FIG. 2) can form electrical connections at contacting surfaces 812 of spring-loaded contacts 800 (shown in FIG. 9.)

Figure 9:
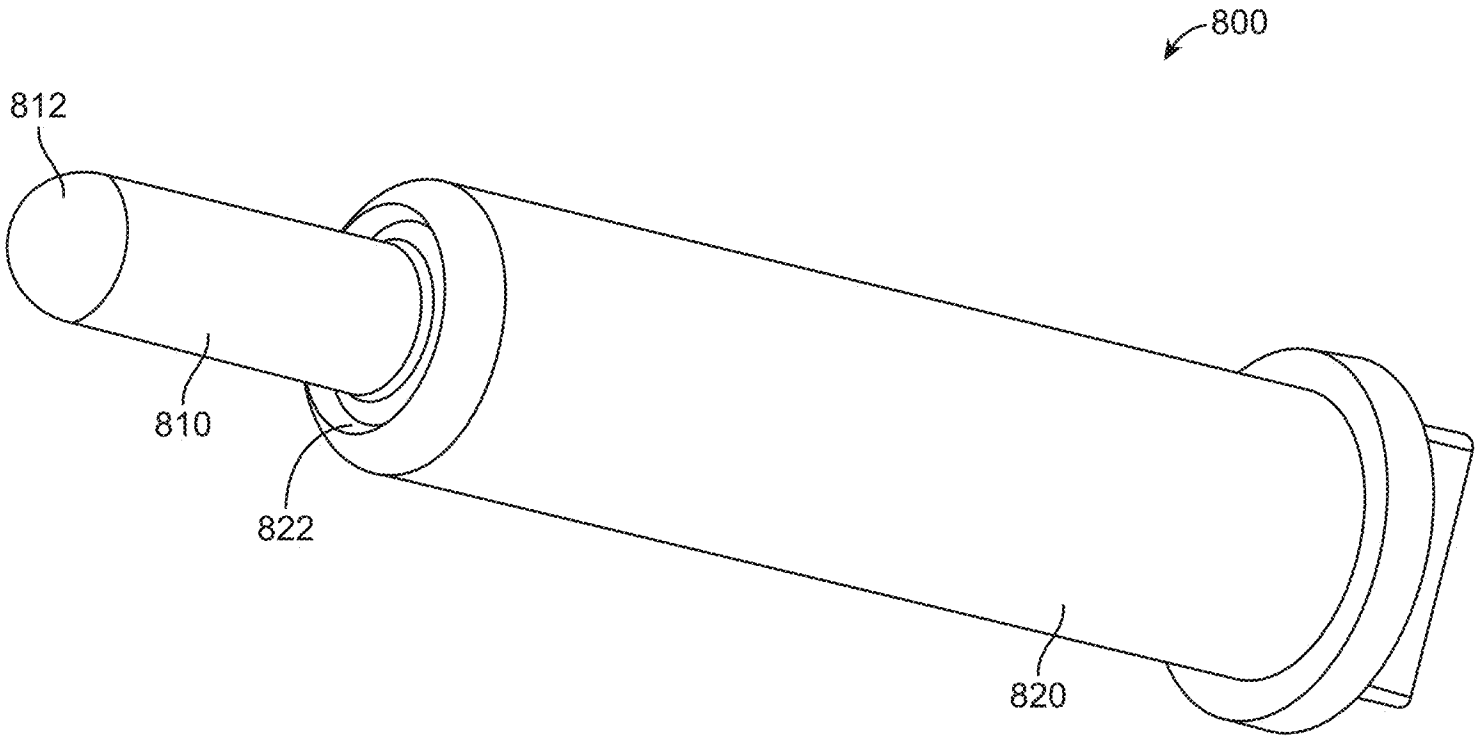
FIG. 9 illustrates a spring-loaded contact according to an embodiment of the present invention.

FIG. 9 illustrates a spring-loaded contact according to an embodiment of the present invention. Spring-loaded contact 800 can include plunger 810. Plunger 810 can include contacting surface 812. Plunger 810 can emerge from opening 822 in barrel 820.

As contact is made between spring-loaded contact 800 and a corresponding contact, such as contacting surface 122 of contact 120 (shown in FIG. 4), the biased plunger 810 can be depressed. Spring 860 (shown in FIG. 10) in spring-loaded contact 800 can thereby apply a force between plunger 810 and the corresponding contact thereby forming an electrical connection. Typically, current in the electrical connection can flow through the plunger and barrel 820. But in some configurations, as plunger 810 is depressed, contact between plunger 810 and the barrel 820 can be broken. In this circumstance, current can flow through spring 860. If spring-loaded contact 800 is a power supply contact, such as a contact providing a power supply voltage or ground, the current can damage or destroy spring 860 thereby rendering the contact inoperable.

Accordingly, an illustrative embodiment of the present invention can provide spring-biased contacts that include an intermediate object between plunger 810 and spring 860 or other biasing structure. Examples are shown in the following figures.

Figure 10:
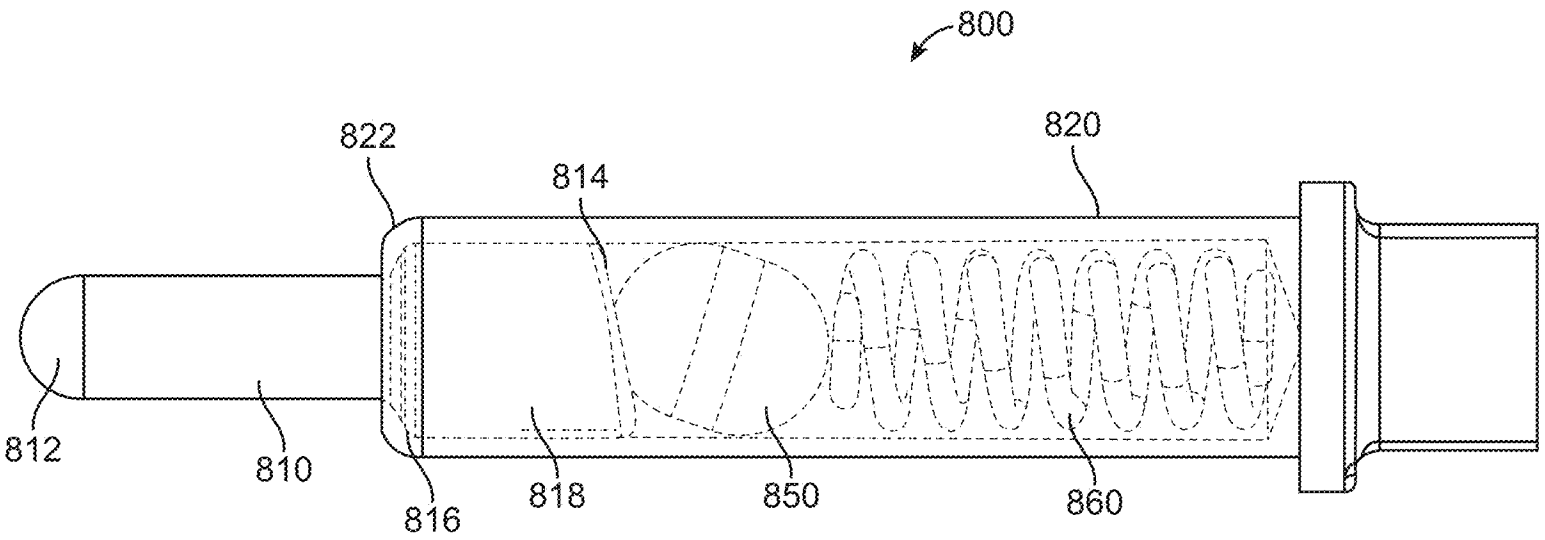
FIG. 10 illustrates a transparent side view of the spring-loaded contact of FIG. 9.

FIG. 10 illustrates a transparent side view of the spring-loaded contact of FIG. 9. Plunger 810 can include contacting surface 812. Plunger 810 can further include neck 816 leading to body 818. Body 818 can be retained inside barrel 820 by opening 822. Plunger 810 can include backside 814. Backside 814 can contact intermediate object 850. Intermediate object 850 can be positioned between plunger 810 and spring 860. Spring 860 can act to push plunger 810 out of barrel 820 and can be compliant such that plunger 810 can be depressed into barrel 820 of spring-loaded contact 800 when mated with a corresponding contact contacting surface 122 (shown in FIG. 2.)

Figure 11:
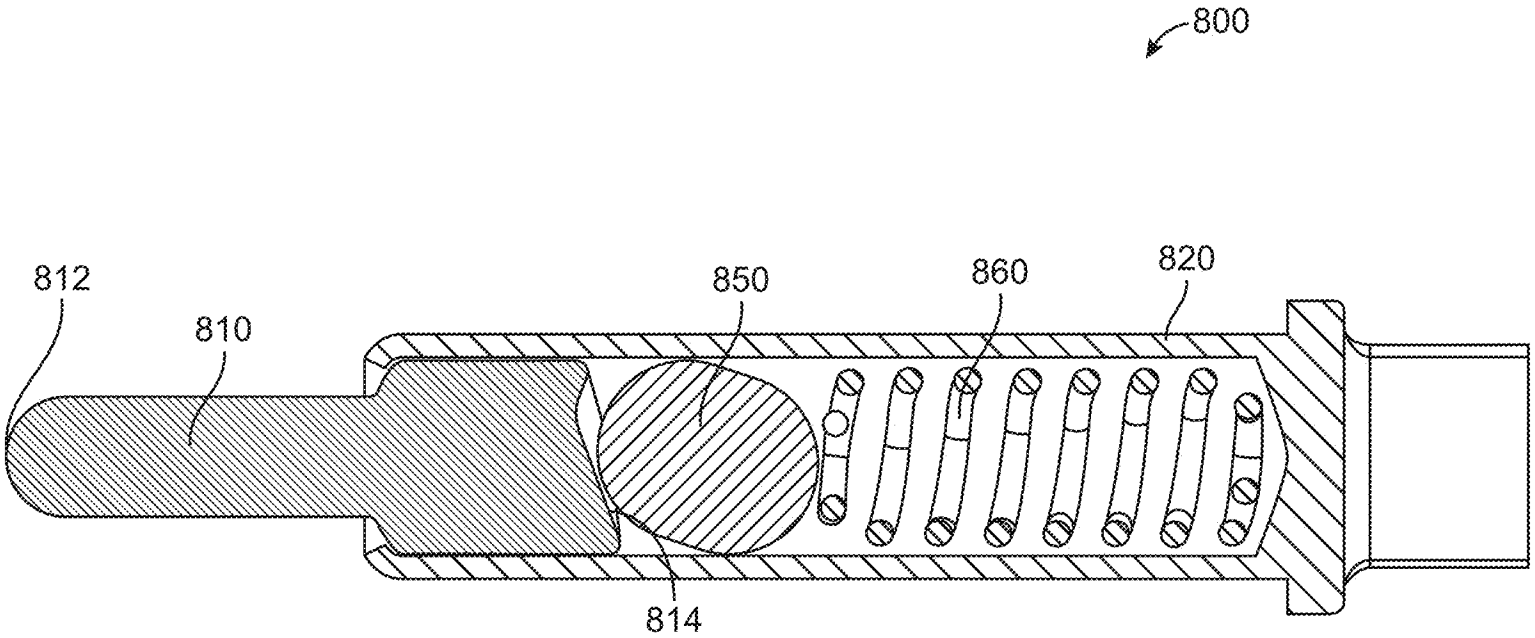
FIG. 11 illustrates a cutaway side view of the spring-loaded contact of FIG. 9.

FIG. 11 illustrates a cutaway side view of the spring-loaded contact of FIG. 9. Spring-loaded contact 800 can include intermediate object 850 in barrel 820. Intermediate object 850 can be positioned between plunger 810 and spring 860. Intermediate object 850 can contact backside 814 of plunger 810. Plunger 810 can further have contacting surface 812. Spring 860 can push intermediate object 850 against backside 814 of plunger 810.

Figure 12:
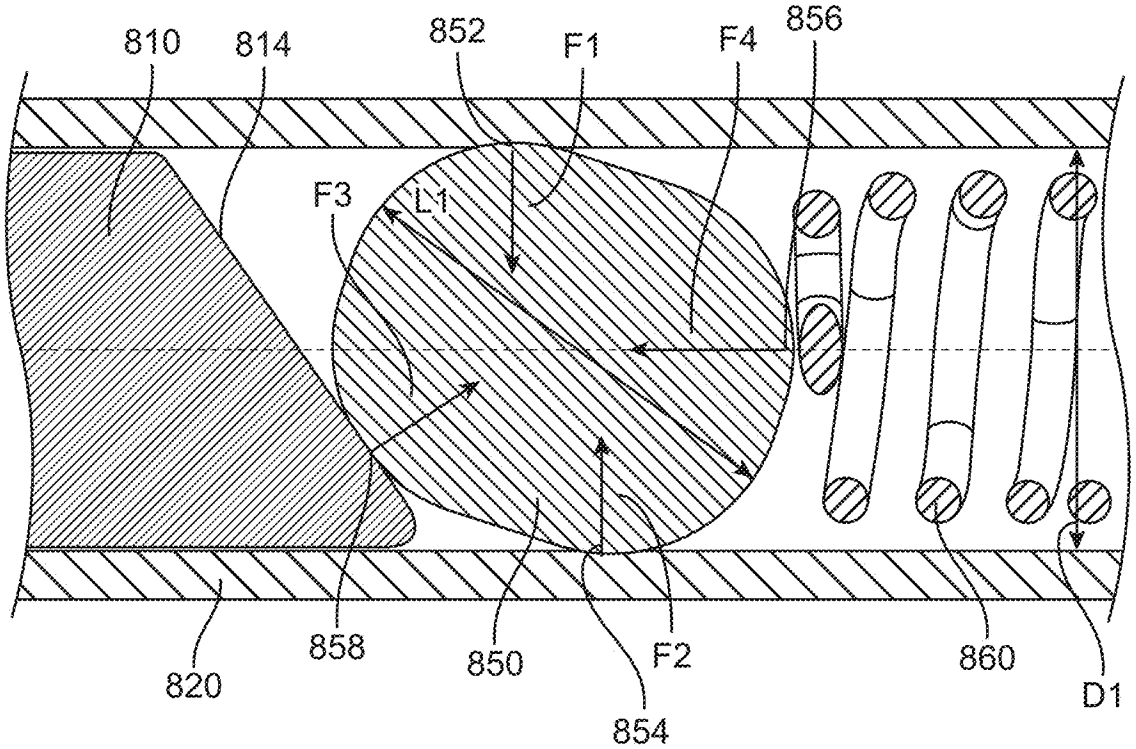
FIG. 12 is a more detailed view of an intermediate object that can be used in the spring-loaded contact of FIG. 9.

FIG. 12 is a more detailed view of an intermediate object that can be used in the spring-loaded contact of FIG. 9. Intermediate object 850 can be positioned between plunger 810 and spring 860. Intermediate object 850 can encounter backside 814 of plunger 810 as well as spring 860. Intermediate object 850 can provide multiple paths for currents in spring-loaded contact 800. For example, current can flow though plunger 810 into intermediate object 850 and through first location 852 to barrel 820. Current can also flow though plunger 810 into intermediate object 850 and through second location 854 to barrel 820. These current paths can help to limit current through spring 860. The currents in barrel 820 can then flow through other conduits that are connected to barrel 820, such as wires, board traces, or others (not shown.)

Intermediate object 850 can have a first length L1 that is greater than a diameter D1 of barrel 820. Intermediate object 850 can be between a backside 814 of plunger 810 and spring 860, where intermediate object 850 simultaneously contacts an inside surface of barrel at first location 852 and second location 854. First location 852 and second location 854 can be on opposite sides of intermediate object 850. First location 852 can be a first distance (not shown) from front opening 822 of barrel 820 and second location 854 can be a second distance (not shown) from front opening 822, the first distance different than the second distance.

In these and other embodiments of the present invention, an inside surface of barrel 820 can provide a first force along a first force vector F1 against intermediate object 850 at first location 852. The inside surface of barrel 820 can provide a second force along a second force vector F2 against intermediate object 850 at second location 854. The first force vector F1 and the second force vector F2 can be parallel and non-overlapping. Backside 814 of plunger 810 can provide third force vector F3 to intermediate object 850. Spring 860 can provide fourth force vector F4 to intermediate object 850.

Figure 13A:
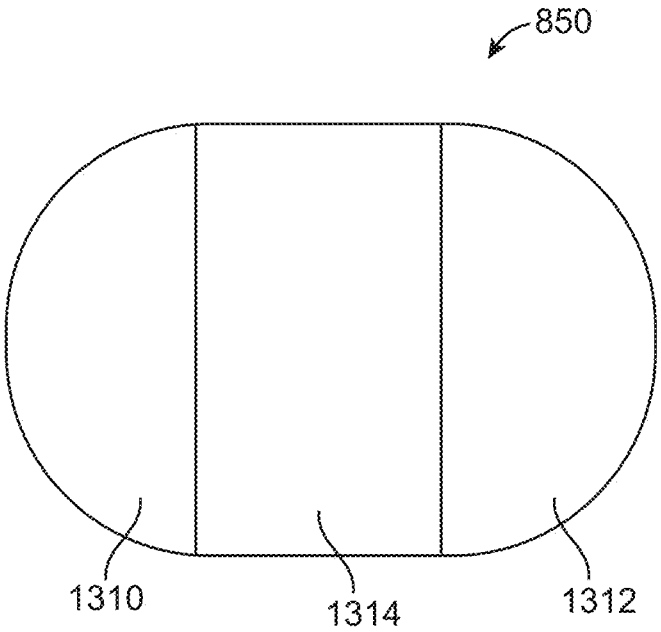
FIGS. 13A and 13B illustrate an intermediate object according to an embodiment of the present invention.
Figure 13B:
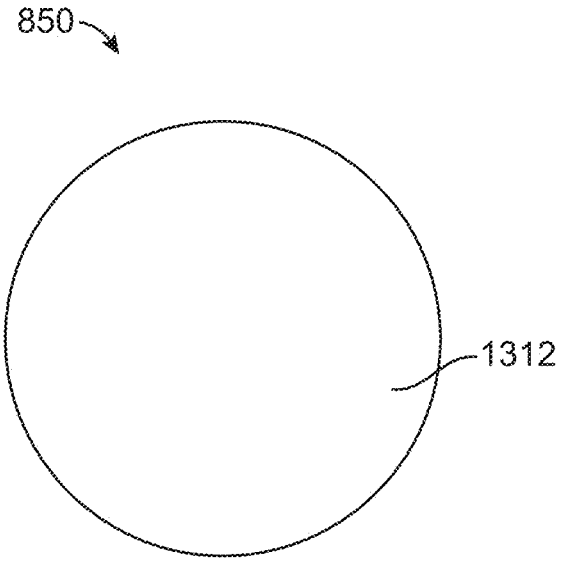

FIG. 13 illustrates an intermediate object according to an embodiment of the present invention. Intermediate object 850 can have various shapes. For example, intermediate object 850 can have a capsule shape. Intermediate object 850 can have a stadium-of-rotation shape. Intermediate object 850 can have a spherocylinder shape. Intermediate object 850 can have a shape defined by two hemispheres 1310 and 1312 separated by cylinder 1314.

Figure 14:
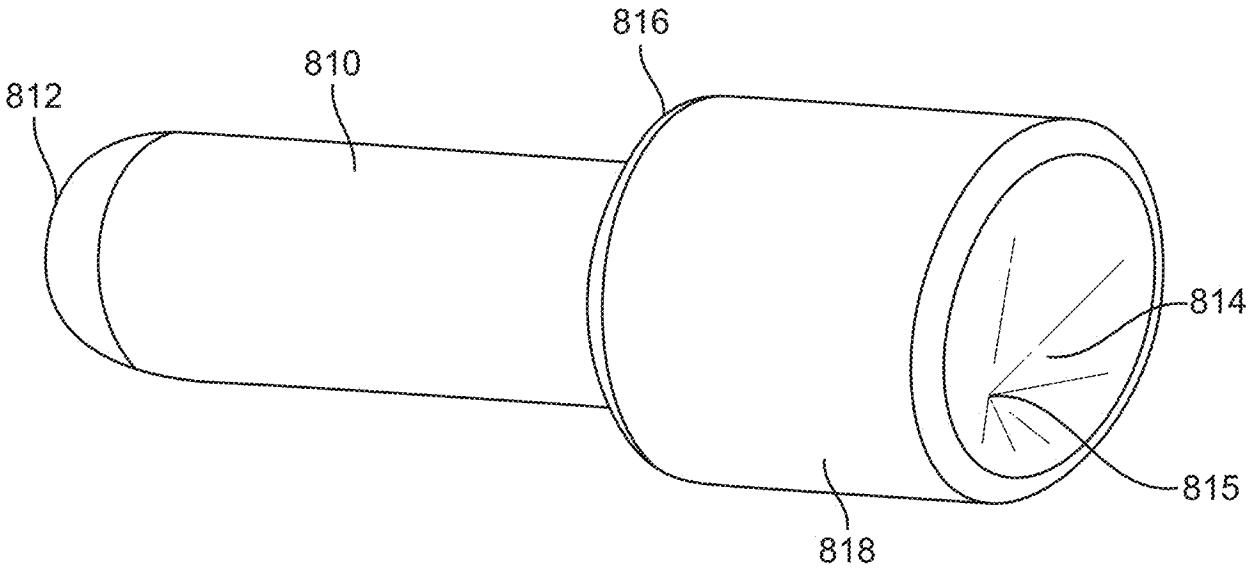
FIG. 14 is a more detailed view of a plunger for the spring-loaded contact of FIG. 9.

FIG. 14 is a more detailed view of a plunger for the spring-loaded contact of FIG. 9. Plunger 810 can include contacting surface 812. Plunger 18 can further include neck 816 leading to body 818. Plunger 810 can include backside 814. Backside 814 can be sloped. Backside 814 can have a conical indentation. Backside 814 can have a conical surface. Backside 814 can have an off-center conical surface. Backside 814 can have a sloped off-center conical surface. The conical indention can have an apex at point 815.

Figure 15:
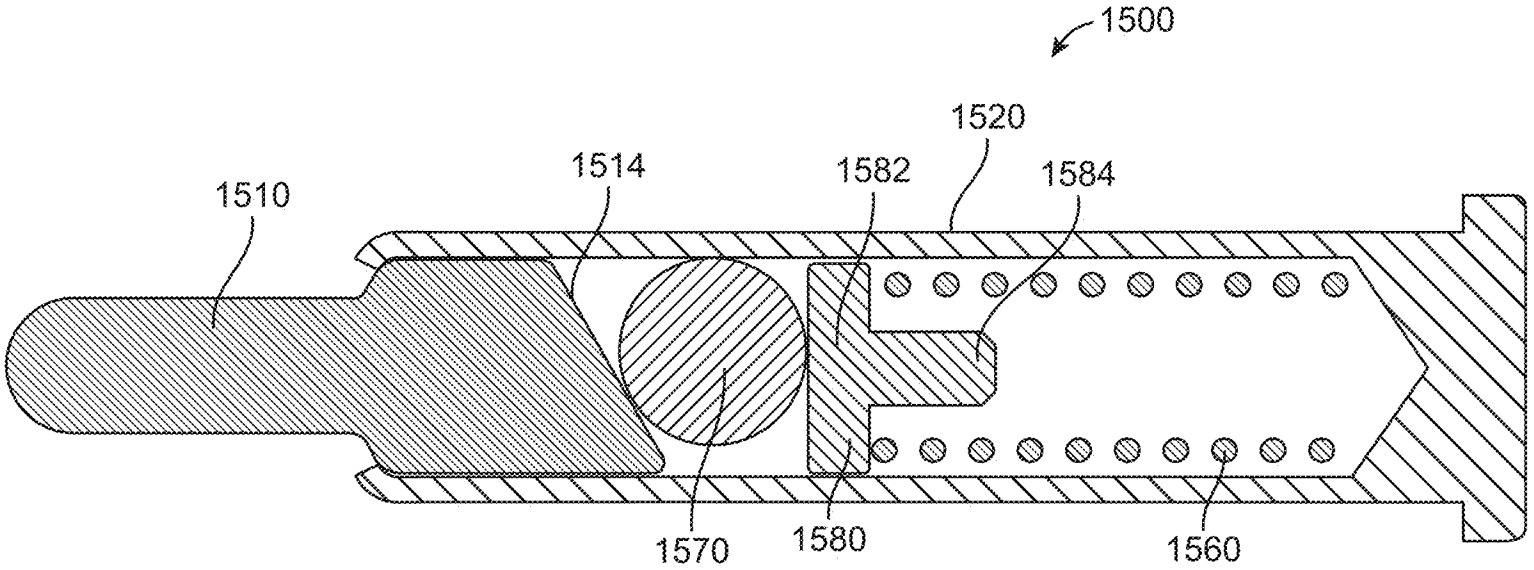
FIG. 15 illustrates another spring-loaded contact according to an embodiment of the present invention.

FIG. 15 illustrates another spring-loaded contact according to an embodiment of the present invention. Spring-loaded contact 1500 can include plunger 1510, intermediate object 1570, piston 1580, and spring 1560. At least a portion of plunger 1510, intermediate object 1570, piston 1580, and spring 1560 can be housed in barrel 1520. Piston 1580 can include head 1582 and tail 1584. Some of spring 1560 can encircle tail 1584 of piston 1580, thereby keeping piston 1580 aligned to spring 1560. Spring 1560 can apply force against head 1582 of piston 1580, thereby pushing ahead 1582 of piston 1580 into intermediate object 1570. Intermediate object 1570 can push against a backside of piston 1580. As spring-loaded contact 1500 engages a corresponding contact, such as contacting surface 122 of contacts 120 (shown in FIG. 4), plunger 1510 can be depressed into barrel 1520. This can compress spring 1560. In this way, spring 1560 can continue to apply a force pushing plunger 1510 against contacting surface 122 when the contacts are mated.

Figure 16:
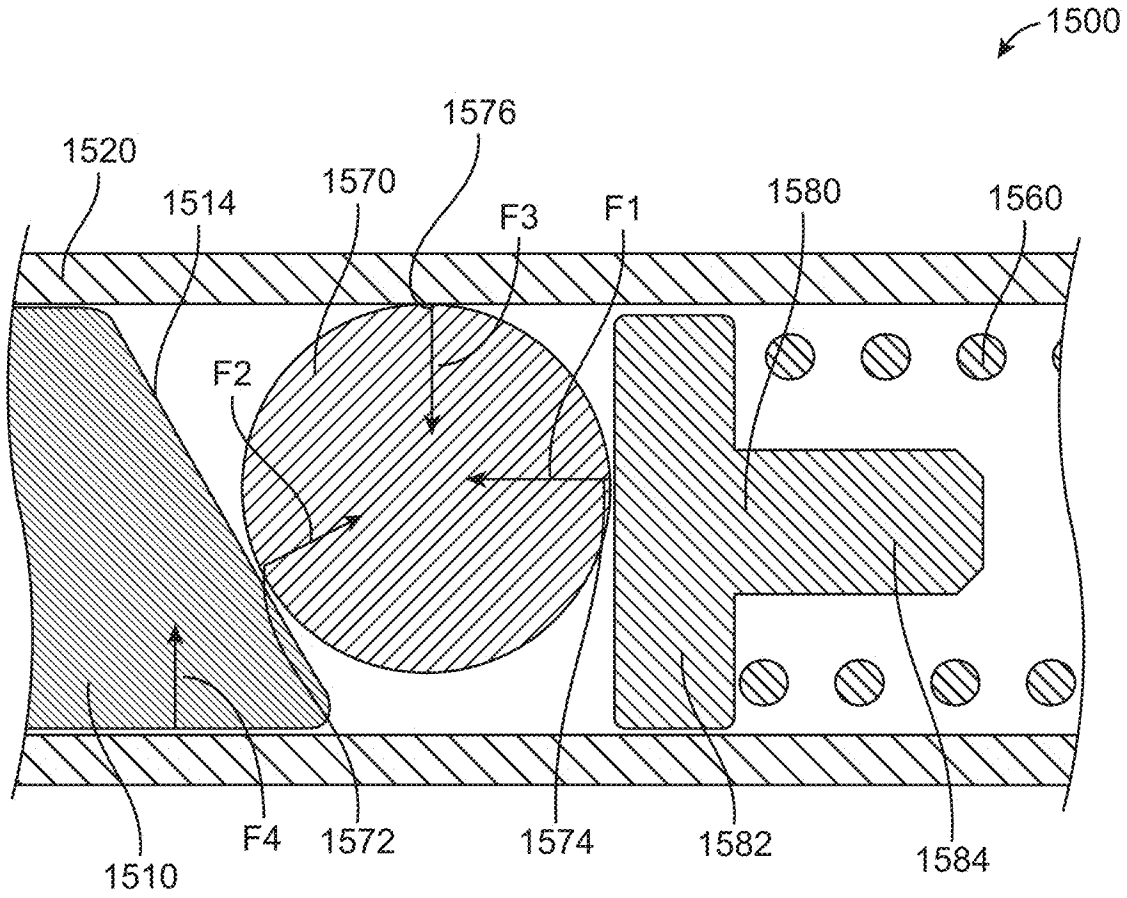
FIG. 16 is a more detailed view of the spring-loaded contact of FIG. 15.

FIG. 16 illustrates a close-up view of a portion of the spring-loaded contact FIG. 15. Spring 1560 can push against head 1582 of piston 1580. Some of spring 1560 can encircle tail 1584 of piston 1580. Spring 1560 can provide force F1 to intermediate object 1570 through head 1582 of piston

1580. This force can be resisted by force F2 applied to location 1572 of intermediate object 1570 by backside 1514 of plunger 1510. These forces can push intermediate object 1570 into barrel 1520 at location 1576 with force F3.

In these and other embodiments of the present invention, intermediate object 1570 can be formed of a conductive material, while piston 1580 can be formed of a nonconductive or insulating material. This arrangement can provide current flow through spring-loaded contact 1500 while protecting spring 1560 from excessive currents. Plunger 1510 can contact intermediate object 1570 at location 1572. Currents can flow through this location through intermediate object 1570 and to barrel 1520 at location 1576. When piston 1580 is nonconductive, current does not flow through intermediate object 1570 to piston 1580 via location 1574. This can protect spring 1560 from seeing excessive current. When piston 1580 is conductive, currents can flow through intermediate object 1570 to piston 1580 via location 1574. Piston 1580 can be can then contact inside surface of barrel 1520 providing and other current path to protect spring 1560.

While embodiments of the present invention can provide connector inserts and connector receptacles for delivering power, these and other embodiments of the present invention can be used as connector receptacles in other types of connector systems, such as connector systems that can be used to convey power, data, or both.

In various embodiments of the present invention, contacts, shields, plungers, springs, pistons, isolation objects, barrels, and other conductive portions of a connector receptacle or connector insert can be formed by stamping, metal-injection molding, machining, micro-machining, CNC machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as housings, locks, pistons, and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The printed circuit boards or other boards used can be formed of FR-4 or other material.

Embodiments of the present invention can provide connector receptacles and connector inserts that can be located in, and can connect to, various types of devices such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. These connector receptacles and connector inserts can provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A spring-loaded contact comprising:

a barrel having a front opening;

a plunger having a tip extending through the front opening and a body housed in the barrel;

a spring housed in the barrel; and an intermediate object between a backside of the plunger and the spring, wherein the intermediate object simultaneously contacts an inside surface of barrel at a first location a first distance from the front opening and a second location a second distance from the front opening, the first location and the second location on opposite sides of the intermediate object, and wherein the intermediate object is shaped such that the first distance is different than the second distance.

2. The spring-loaded contact of claim 1 wherein the intermediate object has a capsule shape.

3. The spring-loaded contact of claim 1 wherein the intermediate object has a stadium-of-rotation shape.

4. The spring-loaded contact of claim 1 wherein the intermediate object has a spherocylinder shape.

5. The spring-loaded contact of claim 1 wherein the intermediate object has a shape defined by two hemispheres separated by a cylinder.

6. The spring-loaded contact of claim 1 wherein the inside surface of the barrel provides a first force along a first force vector against the intermediate object at the first location and the inside surface of the barrel provides a second force along a second force vector against the intermediate object at the second location, and wherein the first force vector and the second force vector are parallel and non-overlapping.

7. The spring-loaded contact of claim 1 wherein the intermediate object has a first length and the barrel has a first diameter, and wherein the first length is greater than the first diameter.

8. The spring-loaded contact of claim 1 wherein the backside of the plunger has a sloped off-center conical surface.

9. A spring-loaded contact comprising:

a barrel having a front opening;

a plunger having a tip extending through the front opening and a body housed in the barrel;

a spring housed in the barrel; and an intermediate object between a backside of the plunger and the spring, wherein the intermediate object has a shape defined by two hemispheres separated by a cylinder.

10. The spring-loaded contact of claim 9 wherein the intermediate object simultaneously contacts an inside surface of barrel at a first location and a second location, the first location and the second location on opposite sides of the intermediate object.

11. The spring-loaded contact of claim 10 wherein the first location is a first distance from the front opening and the second location is a second distance from the front opening, the first distance different than the second distance.

12. The spring-loaded contact of claim 11 wherein the inside surface of the barrel provides a first force along a first force vector against the intermediate object at the first location and the inside surface of the barrel provides a second force along a second force vector against the intermediate object at the second location, and wherein the first force vector and the second force vector are parallel and non-overlapping.

13. The spring-loaded contact of claim 12 wherein the intermediate object is conductive.

14. The spring-loaded contact of claim 12 wherein the backside of the plunger has a sloped off-center conical surface.

15. The spring-loaded contact of claim 14 wherein the spring-loaded contact is in a connector insert.

16. A spring-loaded contact comprising:

a barrel having a front opening;

a plunger having a tip extending through the front opening and a body housed in the barrel;

a spring housed in the barrel; and an intermediate object between a backside of the plunger and the spring, wherein the intermediate object simultaneously contacts an inside surface of barrel at a first location and a second location, the first location and the second location on opposite sides of the intermediate object, and wherein the inside surface of the barrel simultaneously provides a first force along a first force vector against the intermediate object at the first location and the inside surface of the barrel provides a second force along a second force vector against the intermediate object at the second location, and wherein the intermediate object is shaped such that the first force vector and the second force vector are parallel and non-overlapping.

17. The spring-loaded contact of claim 16 wherein the intermediate object has a shape defined by two hemispheres separated by a cylinder.

18. The spring-loaded contact of claim 17 wherein the intermediate object is conductive.

19. The spring-loaded contact of claim 18 wherein the backside of the plunger has a sloped off-center conical surface.

20. The spring-loaded contact of claim 18 wherein the spring-loaded contact is in a connector insert.

* * * * *